United States Patent [19]

Hudson et al.

[11] 4,194,959

[45] Mar. 25, 1980

[54] ELECTROLYTIC REDUCTION CELLS

[75] Inventors: Thomas J. Hudson, Arvida; Jean-Paul R. Huni, Kingston; Vinko Potocnik; Donald W. MacMillan, both of Arvida, all of Canada

[73] Assignee: Alcan Research and Development Limited, Montreal, Canada

[21] Appl. No.: 961,200

[22] Filed: Nov. 16, 1978

[30] Foreign Application Priority Data

Nov. 23, 1977 [GB] United Kingdom ..... 48800/77

[51] Int. Cl.[2] ..... C25C 3/06; C25C 3/16

[52] U.S. Cl. ..... 204/243 R; 204/67

[58] Field of Search ..... 204/67, 243 R-247

[56] References Cited

U.S. PATENT DOCUMENTS

| | | | |
|---|---|---|---|
| 2,528,905 | 11/1950 | Ollivier et al. | 204/243 R |
| 2,868,710 | 1/1959 | Pontremoli | 204/243 R |
| 2,874,110 | 2/1959 | Thayer | 204/243 M |
| 3,067,124 | 12/1962 | De Pava | 204/243 R X |
| 3,575,827 | 4/1971 | Johnson | 204/244 X |
| 3,787,311 | 1/1974 | Wittner et al. | 204/243 R X |

*Primary Examiner*—John H. Mack
*Assistant Examiner*—D. R. Valentine
*Attorney, Agent, or Firm*—Cooper, Dunham, Clark, Griffin & Moran

[57] ABSTRACT

An electrolytic reduction cell for the production of aluminium has current collector bars running across the floor of the cell unitarily or in separate sections. Deformation of the molten metal/electrolytic bath interface is reduced by leading current out of the collector bars or bar sections at positions remote from their ends by connector bars connected to said positions.

5 Claims, 1 Drawing Figure

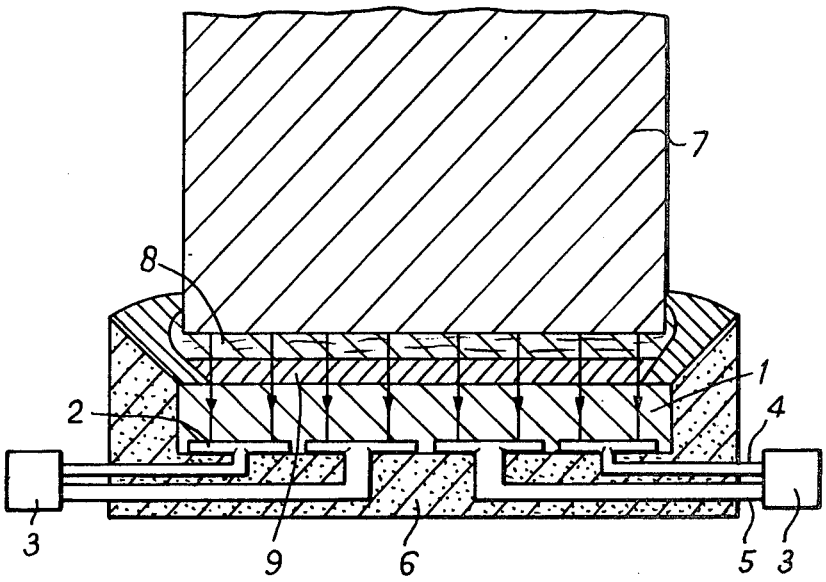
7
8
1
2
4
3
9
6
5
3

ELECTROLYTIC REDUCTION CELLS

The present invention relates to electrolytic reduction cells, in which the floor of the cell constitutes the cathode structure. In such cells, which are employed in the electrolytic production of aluminium, a pad of molten metal forms on the floor of the cell underneath the molten electrolytic reduction bath, into which the anode or anodes dip from the head supports. To achieve maximum efficiency in utilisation of electric power it is important that the distance between the lower surface of the anode and the surface of the cathode, as constituted by the upper surface of the molten metal pad, remains as closely as possible in accordance with the pre-selected distance. It will accordingly be understood that any disturbance of the upper surface of the metal pad can be deterimental to the efficiency of the cell operation.

Electrolytic reduction cells operate at low voltages and very high currents. The cells are connected in series and arranged in a line. The current is carried from one cell to the next by large conductors connecting the cathode of one cell to the anode of the cell next in the line. The current flowing through the cell and in the conductors gives rise to a substantial magnetic field in and around the cell. This magnetic field can cause substantial disturbance of the metal pad in the electrolytic cell by reason of electromagnetic forces arising from the interaction of the current flowing in the metal pad with the magnetic field.

The object of this invention is to provide an improved, but simple, construction of the cathode of the electrolytic reduction cell which will result in a metal pad behaviour better suited for the achievement of maximum efficiency and control. The metal pad behaviour is improved by decreasing and controlling the horizontal current component flowing transversely to the cell in the metal pad. Since the electromagnetic force is proportional to, among other things, current density this invention provides a very effective means for the control of metal pad behaviour and cell stability.

In constructing the cathode of a conventional electrolytic reduction cell the carbon cathode blocks, forming the floor of the cell, are laid lengthwise across the cell. The underside of the cathode blocks is grooved lengthwise to receive metal (usually steel) collector bars which extend laterally beyond the blocks through the sides of the cell for connection to the main line conductors. These collector bars are then cast iron rodded or cemented in position by means of a pitch-carbon composition, which subsequently becomes carbonised as the cell heats up, thereby establishing a good electrical connection between the carbon block and the metal collector bar. Although many other means of connecting cathode floor blocks to metal collector bars have been suggested the above-mentioned methods are normally employed because of their simplicity.

Since the carbon cathode blocks are relatively good thermal conductors it is necessary that the collector bars should be formed of a metal having a higher melting point than the operating temperature of the cell and for that reason they are commonly made of steel.

We have appreciated that the actual path of 5 current between the electrolytic bath and the cathode collector bars leads to a substantial current component through the molten metal pad in a horizontal direction transversely of the cell because the path of least resistance from the electrolytic bath to the line conductor lies through the metal pad to the side of the cell and then down through the carbon floor block to the collector bar. This leads to a relatively large current density at the steel/carbon interface at locations close to the side of the cell.

An arrangement in which the current enters the collector bars through a relatively small area near their ends is open to the objection that the voltage drop between the collector bars and the carbon is unduly high because of the high current density. The present invention, by aiming to reduce transverse horizontal currents in the metal pad, also aims to reduce the voltage drop across steel/carbon interface by reducing variations in the current density at the interface. A more uniform current density also leads to a reduction in voltage drop across the cathode carbon block with possible economy in the consumption of electrical energy.

The electromagnetic forces which result in the distrubance of the metal pad arise from the interaction of the current in the metal pad with the magnetic field. These forces produce deformation of the metal-bath interface in both transverse and longitudinal directions, whilst at the same time establishing circulatory motions in the metal pad and bath. A distance between the anode and the cathode sufficiently large to avoid direct contact between the metal pad and the anode must be maintained in spite of these disturbances. This leads to the distance of the anode from the cathode being maintained at a larger value than would be necessary if the metal pad could be maintained in a more quiescent and planar condition. The desired improved condition can be achieved in principle by one of two different approaches. The common approach is to improve the distribution of magnetic fields by for example appropriate positioning of the external conductors and/or magnetic shielding. The alternative approach, which is employed in the present invention, is to improve the current distribution in the cell. Essentially in the present invention the improvement in current distribution is achieved by arranging that the current flow from the metal/electrolytic bath interface to the line conductors is primarily in a vertical direction through the metal pad with consequent reduction in the horizontal currents in the metal pad in the transverse direction. By reduction of the horizontal transverse current the forces resulting from the interaction of the vertical component of the magnetic field and the transverse current in the metal pad are reduced. Also the more uniform vertical current distribution leds to a force field in the metal pad which favours less deformation and circulation.

In order to achieve the desired result of reducing the deformation of the metal-bath interface and the amount of metal circulation the present invention contemplates leading current out of the collector bars at a position remote from their ends.

According to the invention there is provided an electrolytic reduction cell for the production of aluminium having a floor which constitutes the cell cathode; and current collector bars located in the underside of the floor to take cathode current therefrom; characterised in that there is provided a plurality of connector bars for each collector bar and each connector bar is connected at a respective intermediate point between the ends of a collector bar or collector bar section, each collector bar being unitary or in separate sections.

In a preferred arrangement the collector bar of a cathode block is divided into a number of separate sections, each of which is connected to an individual associated connector bar at a position remote from its ends. In some instances the collector bar is not itself physically divided into separate sections but is connected to two or more connector bars at positions preferably symmetrical in relation to its mid-point (but remote from its ends). By arranging that the current is led out from the collector bar or collector bar sections at positions remote from their ends the magnitude of the remaining transverse currents in the metal pad is greatly reduced and any remaining currents have then been rearranged so as to oppose each other locally. The resulting interaction of these currents and the vertical components of the magnetic field will be correspondingly reduced and localized, thus improving metal pad deformation and circulation.

In a preferred arrangement of the electrolytic reduction cell in accordance with the invention the collector bar is subdivided into four separate sections, from which current is taken out at or near the mid-point of each section. The resistances of the connector bars are chosen such that pre-selected currents are drawn from each collector bar section. This can be achieved either by sizing the connector bars and/or by introducing external resistors.

BRIEF DESCRIPTION OF THE DRAWING

The accompanying drawing shows a cross-section of an electrolytic cell in accordance with the invention.

The floor of the cell is composed of carbon cathode blocks 1, which are laid lengthwise across the cell and are grooved lengthwise in the conventional manner to receive collector bar sections 2. The collector bar sections 2 are connected to the line conductors 3 by connector bars 4 and 5 respectively. The connector bars 4 are of lighter gauge than the connector bars 5, so as approximately to equalize the current density at the collector bar sections 2. As will be seen at the collector bars 4 and 5 are led through the insulation layer 6 to the mid-points of the respective collector bar sections 2. In consequence the cathode current in each collector bar section 2 on opposite sides of the mid-points flows in opposed directions. In this cell arrangement the current from the anode 7 through the bath 8 and metal pad 9 has relatively small components transverse of the cell in its passage through the metal pad compared with conventional cells.

This has the effect of decreasing the circulatory flow in the metal pad. It is however desirable that some controlled circulation should be achieved and to this end it is desirable to arrange a cell of the present invention so that more or less than the average current is drawn from the collectors near the ends of the cell. This leads to localized circulation in each of the four quadrants of the cell. This may be most conveniently arranged by having the connector bars 4 of the last two or three rows of collector bars of somewhat lower or higher resistance.

It will readily be understood that the principles of the invention may be applied in similar, if simpler and possibly less effective structures.

Thus in an alternative construction a single collector bar is employed in conjunction with a pair of connector bars connected to it on both sides of its mid-point, preferably midway between its mid-point and its ends.

In another arrangement two collector bar sections are employed and a related connector bar is connected to each section at a position somewhat offset from the mid-point of the collector bar section, preferably towards the centre line of the cell.

It is an advantage of all the envisaged arrangements, at least for all those structures in which the collector bar is actually or effectively divided into separate sections, that the deformation and/or disturbance of the metal pad is reduced with the result that a smaller anode-to-cathode distance may be employed which will result in a lower voltage drop in the electrolyte between the anode and cathode with further economy in electrical energy employed in the process.

EXAMPLE

Two cathodes were constructed according to the design of FIG. 1, placed in a 128 KA vertical stud Soderberg potline and operated under normal plant conditions for some months. During this time cathode current distribution and other parameters were measured and compared with results as predicted by a mathematical model. Apart from the design features shown in FIG. 1, the cathode was designed to operate with the same thermal balance as a normal cathode. The measured current distribution compared very well with that predicted and showed reduction of transverse horizontal current density by a factor of three to five depending on freeze profile, metal depth, etc.

The stability criteria of the cells is the time "on shake", i.e. the number of hours per day during which the voltage fluctuations are more than 150 mv. Throughout the period of measurement, the average time "on shake" of the experimental cells was lower by a factor of eight than that of the control cells. The point of incipient instability was approximately 1 volt lower than on neighbouring control cells.

Although the results show that the cell voltage could have been significantly reduced whilst maintaining stable operation, this could not be taken advantage of in the test cells used for this experiment because of requirements of the cell thermal balance. These demanded that the cell be run at the same voltage as the control cells. However, in a new cathode design, it would be possible to take advantage of the increased stability of the metal pad and thus achieve a lower energy consumption, i.e. decreased cell voltage.

We claim:

1. An electrolytic reduction cell for the production of aluminium, said cell having a carbonaceous floor which constitutes the cell cathode, means for supporting a body of molten electrolyte and a pad of molten metal over said floor and anode means arranged to contact such electrolyte, said cell being provided with longitudinally arranged line conductors extending along both longitudinal sides of said cell for connection to said floor cathode at longitudinally spaced positions therealong; wherein the improvement comprises: a plurality, greater than two, of separate metallic collector members at each of said positions, said carbonaceous floor being arranged in electrical connection with said collector members, said separate metallic collector members being spaced apart and extending laterally of said cell at each of said positions and arranged symmetrically with relation to the longitudinal centre line of the cell; and a plurality of connector members, one for each collector member, each of said collector members being electrically connected intermediate its ends to a connector member, leading to a line conductor and electrically insulated with regard to said floor, the resistance of the connection between each collector member and the associated line conductor being sized to provide a desired current distribution and reduced transverse current flow in the pad of molten metal in the region of such collector member.

2. A cell as defined in claim 1, wherein the connector members for at least some of said collector members are connected to their associated collector members at about the midpoints of the collector members.

3. A cell as defined in claim 1, wherein at each of said positions, the respective resistances of the connections between the plural collector members at that position and the line conductors are sized such that the respective current densities at the plural collector members at that position are substantially equalized.

4. A cell as defined in claim 1, wherein the connections between the collector members at or near the ends of the cell and their associated line conductors have resistances such that the current drawn from the last-mentioned collector members differs from the average current drawn from the collector members whereby to establish a limited current in the metal pad in a direction generally longitudinal of said cell.

5. An electrolytic reduction cell for the production of aluminium, including a floor which constitutes the cell cathode; means for supporting a body of molten electrolyte and a pad of molten metal over the floor; an anode disposed for contact with the electrolyte; and a plurality of collector means respectively disposed at longitudinally spaced positions along the cell for taking cathode current from said floor, some of said collector means being adjacent the ends of the cell and others of said collector means being intermediate the ends of the cell, each of said collector means comprising a row of at least two separate collector members spaced apart and extending laterally of said cell in electrical connection with said floor and, for each of said collector members, a connector member connected thereto intermediate the ends of the collector member for conducting current therefrom; wherein the improvement comprises: said collector means respectively having electrical resistances such that the resistances of the collector means adjacent the ends of the cell differ from the resistances of said intermediate collector means for establishing a limited longitudinal current flow in the molten metal pad.

* * * * *

UNITED STATES PATENT AND TRADEMARK OFFICE

CERTIFICATE OF CORRECTION

PATENT NO. : 4,194,959

DATED : March 25, 1980

INVENTOR(S) : Thomas J. Hudson et al.

It is certified that error appears in the above-identified patent and that said Letters Patent are hereby corrected as shown below:

Col. 1, line 64, before "current" delete "5".

Col. 2, lines 19 and 20, "distrubance" should read --disturbance-- ;

line 50, "leds" should read --leads-- .

Col. 3, line 39, after "seen" delete "at" .

Signed and Sealed this

Sixteenth Day of November 1982

[SEAL]

*Attest:*

GERALD J MOSSINGHOFF

*Attesting Officer* *Commissioner of Patents and Trademarks*